United States Patent [19]

Tuan

[11] Patent Number: 4,998,890

[45] Date of Patent: Mar. 12, 1991

[54] STRESS-COMPENSATED CONTACT ELEMENT OF ELECTRICAL CONNECTOR

[76] Inventor: Kenny Tuan, 5F, No. 30, Lane 423, Yuan-San Road, Chung Ho City, Taipei Hsien, Taiwan

[21] Appl. No.: 548,589

[22] Filed: Jul. 5, 1990

[51] Int. Cl.[5] ..... H01R 23/70

[52] U.S. Cl. ..... 439/326

[58] Field of Search ..... 439/296, 325-328, 439/629-637

[56] References Cited

U.S. PATENT DOCUMENTS 4,713,013 12/1987 Regnier et al. ..... 439/326

4,826,446 5/1989 Juntwait ..... 439/326

*Primary Examiner*—Joseph H. McGlynn

[57] ABSTRACT

A contact element used in an electrical connector for connecting a daughter printed circuit board on a mother board includes two spring contact portions oppositely spaced apart and respectively resiliently integrally secured to a base portion embedded in a bottom portion of a connector base socket and several boundary lines cut on the contact portions, in which upon an insertion of the daughter board the two spring contact portions will resiliently clamp the inserted daughter board and any internal stress caused will be counterbalanced or released by the two spring contact portions by slightly separating any relevant cooperating parts at the boundary lines so as to efficiently insert the daughter board for a sound electrical connection and to prevent any overstress or permanent set of relevant contact elements.

9 Claims, 3 Drawing Sheets

STRESS-COMPENSATED CONTACT ELEMENT OF ELECTRICAL CONNECTOR

BACKGROUND OF THE INVENTION

Walse et al. disclosed a low insertion force electrical connector in their U.S. Pat. No. 4,575,172 by inserting a printed circuit board into a C-shaped portion 70 with two opposed arcuate beam members 72, 74 for clamping the printed circuit board. The C-shaped portion 70 requires further means for preventing the overstressing of beam members 72, 74 beyond their intended limits as mentioned in their original specification. So upon an insertion of the board 12, the C-shaped portion will be subjected to an internal stress acting thereon causing permanent set of the contact elements and poor electrical connection since the C-shaped portion is lacking of any means for releasing the stress.

U.S. Pat. No. 4,737,120 of Grabbe et al. disclosed an electrical connector having a contact 36 for connecting the daughter board 18 with the mother board 34, including a spring 68 for resiliently clamping the board 18 by the two contact portions 66, 50. Since the spring 68 is adjacent to the right contact portion 66, a single side resilience force will act upon the right-leaf contact portion 66 to unbalancedly bias the upper projection 72 of the right contact portion 66 against the lower projection 60 of the left contact portion 50, causing a great bending moment and internal stress in the contact 36. The integral contact 36 is not provided with efficient means for releasing such a stress, thereby still easily causing deformation of the contact elements and poor electrical connection.

The present inventor has found the drawbacks of the conventional electrical connector, and invented the present contact element capable of self-compensation for its internal stress for a satisfactory use in an electrical connector.

SUMMARY OF THE INVENTION

The object of the present invention is to provide a contact element used in an electrical connector including two spring contact portions for resiliently clamping an inserted daughter printed circuit board for electrically connecting the daughter board to a mother board secured with the electrical connector for mutually compensating any stress caused in the clamping and connecting operation of the daughter board in the contact element for an efficient electrical connection of the electrical connector.

Another object of the present invention is to provide a contact element integrally made by resilient and electrically conductive plate, having a plurality of stress-adjusting portions formed in situ on the contact element by directly cutting the relevant spring contact portion for releasing any internal stress caused in the contact element for preventing a permanent set when a printed circuit board is too thick or a seriously vibrating insertion of the board into the socket, and also for a sound electrical connection.

DETAILED DESCRIPTION

Figure 1:
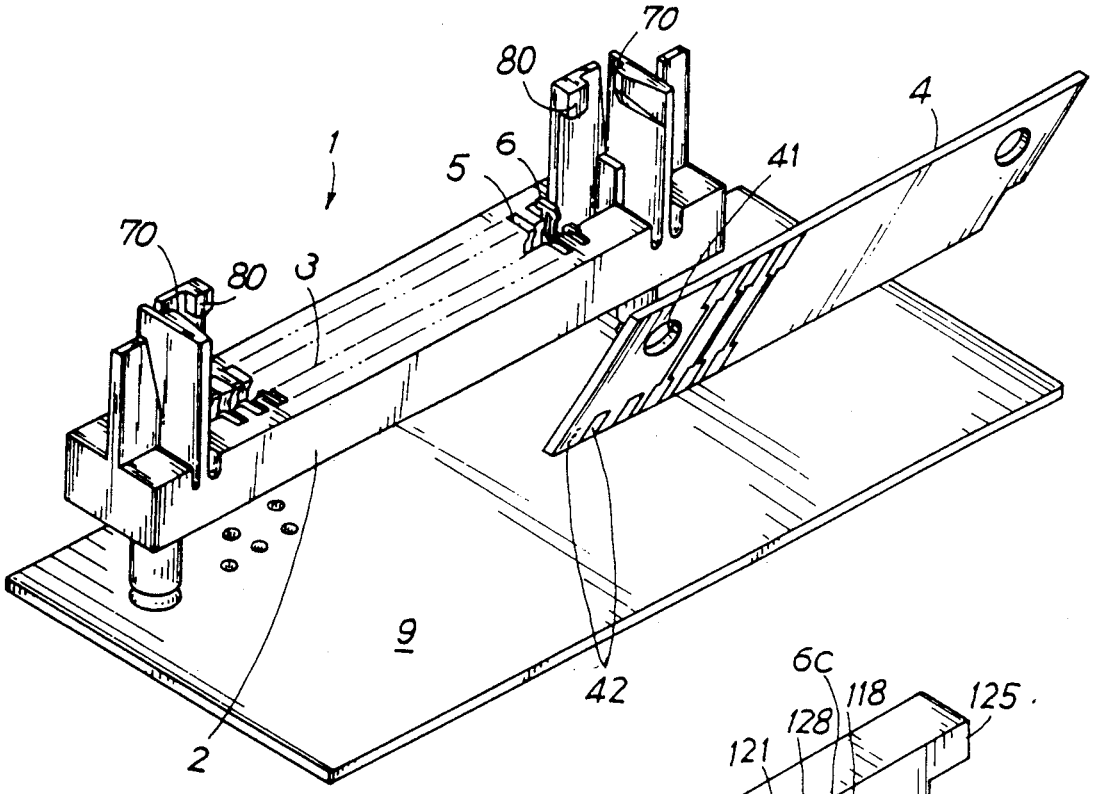
FIG. 1 is an illustration showing an electrical connector for using the present invention.
Figure 2:
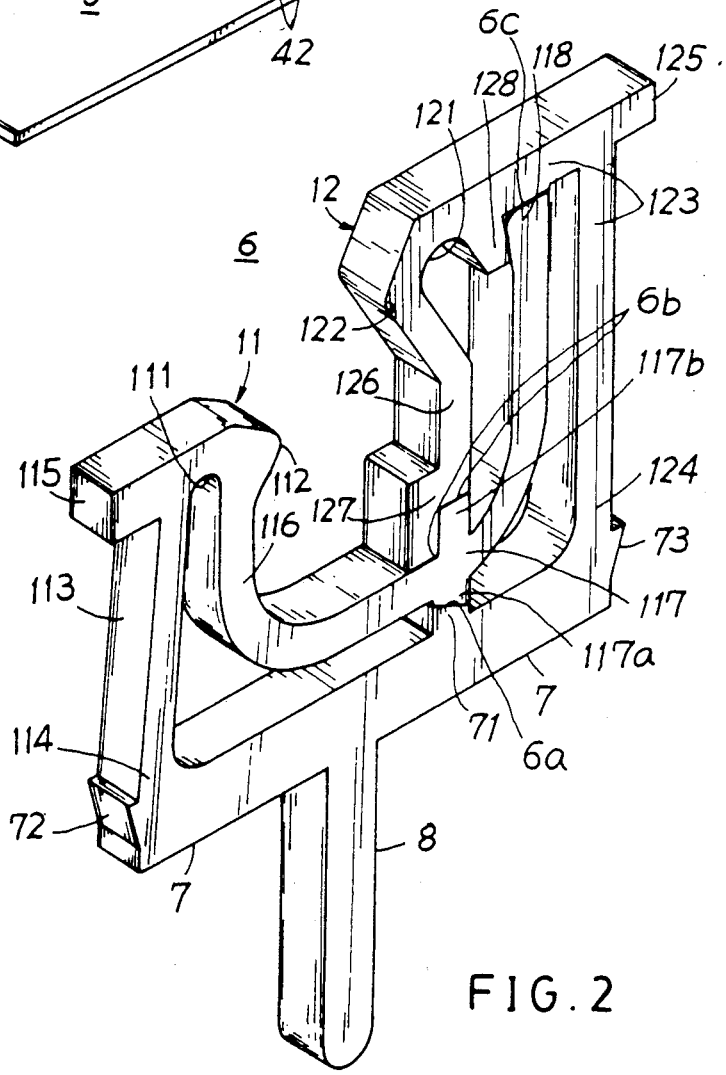
FIG. 2 is a perspective view of the contact element of the present invention.
Figure 3:
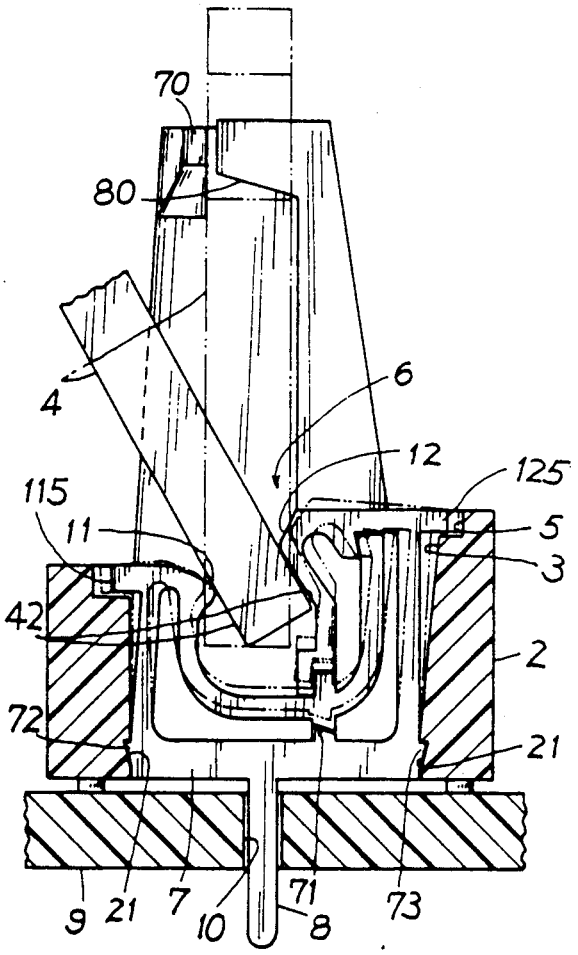
FIG. 3 is a sectional view of the present invention.

As shown in FIG. 1–3, the present invention comprises a plurality contact elements 6 respectively inserted in a plurality of slots 5 transversely formed in an elongate socket 3 longitudinally formed in a connector base 2 secured with a mother board 9, for connecting a daughter printed circuit board 4 inserted in the socket 3 to be clamped and held by the plural contact element 6 of the present invention. The daughter printed circuit board 4 includes two side holes 41 formed in two opposite side portions of the board 4 to be operatively engaged with two fixing protrusion 80 laterally protruding from two posts upstanding on two opposite ends of the base 2. Two positioning latches 70 are also formed on two ends of the base 2 for stably holding the daughter board 4 also by the aid of the two fixing protrusions 80.

As shown in FIG. 2, the contact element 6 of the present invention comprises: a first spring contact portion 11 integrally resiliently secured to a left end portion of a base portion 7 horizontally secured in a bottom portion of the connector base 2, a second spring contact portion 12 oppositely spaced apart from the first spring contact portion 11 also integrally resiliently secured to a right end portion of the base portion 7, and a leg portion 8 protruding downwardly from the base portion 7 through a leg hole 10 formed in the mother board 9 which leg portion 8 can be electrically connected with the mother board 9 by soldering. The contact element 6 may be integrally made from electrically conductive materials such as metallic plate having good resilience.

The first spring contact portion 11 includes: an inner clamping arm member 116 arcuately extending towards the second spring contact portion 12 and an outer supporting arm member 113 having a lower portion 114 resiliently secured to the left end portion of the base portion 7. A contact projection 112 is formed on a right portion of the first contact portion 11 facing a contact projection 122 formed on a left portion of the second contact portion 12. The inner clamping arm member 116 is protruded rightwardly having a central portion 117 and an upper free end portion 118. The central portion 117 includes a lower stem **117*a* protruding downwardly to be normally resting on a central stem 71 of the base portion 7 to form a boundary separating line 6*a* between the two stems 117*a*, 71, and an upper stem 117*b*** protruding upwardly.

The second spring contact portion 12 includes: an inner clamping arm member 126 and an outer supporting arm member 123 having a lower portion 124 resiliently secured to the right end portion of the base portion 7. The inner clamping arm member 126 has a lower free end portion 127 normally engageable with the upper stem **117*b* of the arm member 116 of the first contact portion 11 to form a boundary separating line 6*b* between the lower free end portion 127 and the upper stem 117*b*. The supporting arm member 123 is formed with a protrusion 128 protruding downwardly to normally engage the upper free end portion 118 of the first contact portion 11 forming a boundary separating line 6*c***.

The base portion 7 is formed with two ratchet tooth portions 72, 73 on its two opposite ends for embedding the contact element 6 into a bottom portion of the connector base 2. Two shoulder extensions 115, 125 are formed in two upper ends of the two contact portions 1, 12 to be retained in each slot 5 formed in the base 2. All boundary separating liens 6a, 6b, 6c may be formed in the contact element 6 by directly cutting the element 6 once integrally made from a plate.

After inclinedly inserting the daughter board 4 into the socket 3 of the base 2 as shown in FIG. 3, the conducting areas 42 formed on two lower edges of the daughter board 4 will be resiliently clamped by the two spring contact portions 11, 12. The clamped board 4 will then be vertically erected as shown in dotted line in FIG. 3 by wiping the two contact portions 11, 12 about the base portion 7. Since the two contact portions 11, 12 are provided with two lower portions 114, 124 resiliently integrally secured to the base portion 7, such lower portion 114, 124 serve as pivots for pivotally connecting the supporting arm members 113, 123 so that the board 4 can be inserted in the contact element 6 with a light insertion force, but be firmly clamped by the two contact portions 11, 12. The cooperating elements at each of the three boundary separating lines 6a, 6b, 6c will be slightly slid or separated with each other as shown in dotted line to prevent overstress when inserting the board 4 into the two contact portions 11, 12. For instance, the free end portion 127 of the second contact portion 12 will be operatively sliding or moving from the stem 117b. The protrusion 128 will be separated from the free end 118 of the first contact portion 11, whereas the stem 117a will leave from the stem 71 of the base portion 7. Therefore, an internal stress caused in an electrical connecting operation will be released. The three boundary lines 6a, 6b, 6c may serve as a buffer for overcoming any stress exerting in the electrical connector. The two spring contact portions 11, 12 may normally resiliently clamp an inserted daughter board efficiently. However, under overstress condition, the two spring contact portions 11, 12 each having an inner clamping arm member and an outer supporting member and the three lines 6a–6c will dampen or release the internal stress so that the contact element will have a self compensation effect for compensating the internal stress. The two spring contact portions 11, 12 will mutually compensate the stress acting thereon when clamping the daughter board 4 therebetween.

Figure 4:
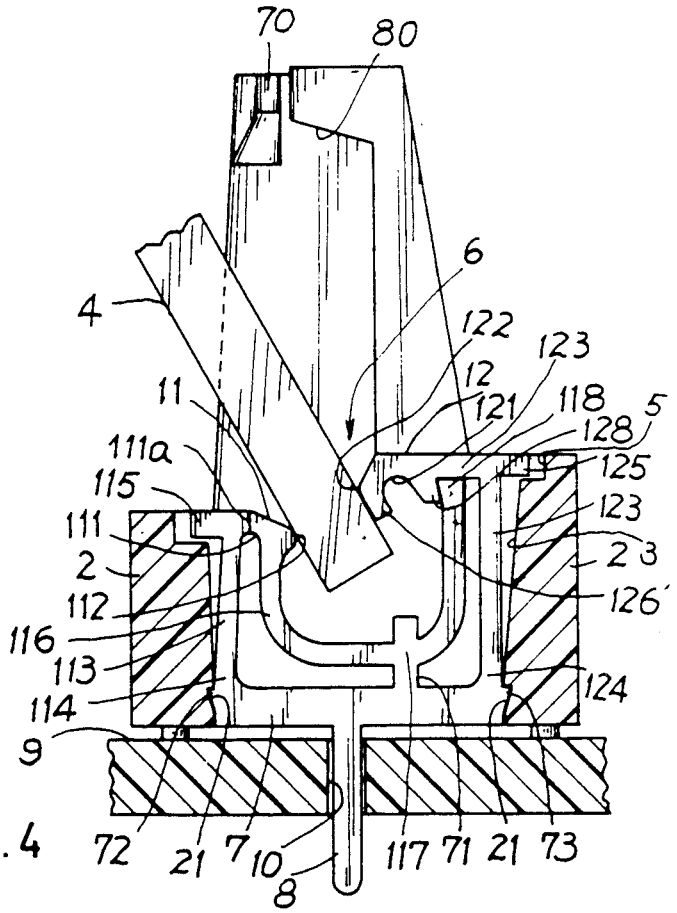
FIG. 4 shows another preferred embodiment of the present invention.

As shown in FIG. 4, the contact element 6 of the present invention is modified to shorten or eliminate the inner clamping arm member 126 of the second contact portion 12 without normally engaging the stem 117 of the arm member 116 of the first contact portion 11. An upper contact projection 126' is formed on the second contact portion 12. A boundary separating line 111a is formed between the inner arm member 116 and the outer supporting member 113, or formed between a central portion of the inner clamping arm member 116 and the base portion 7.

Figure 5:
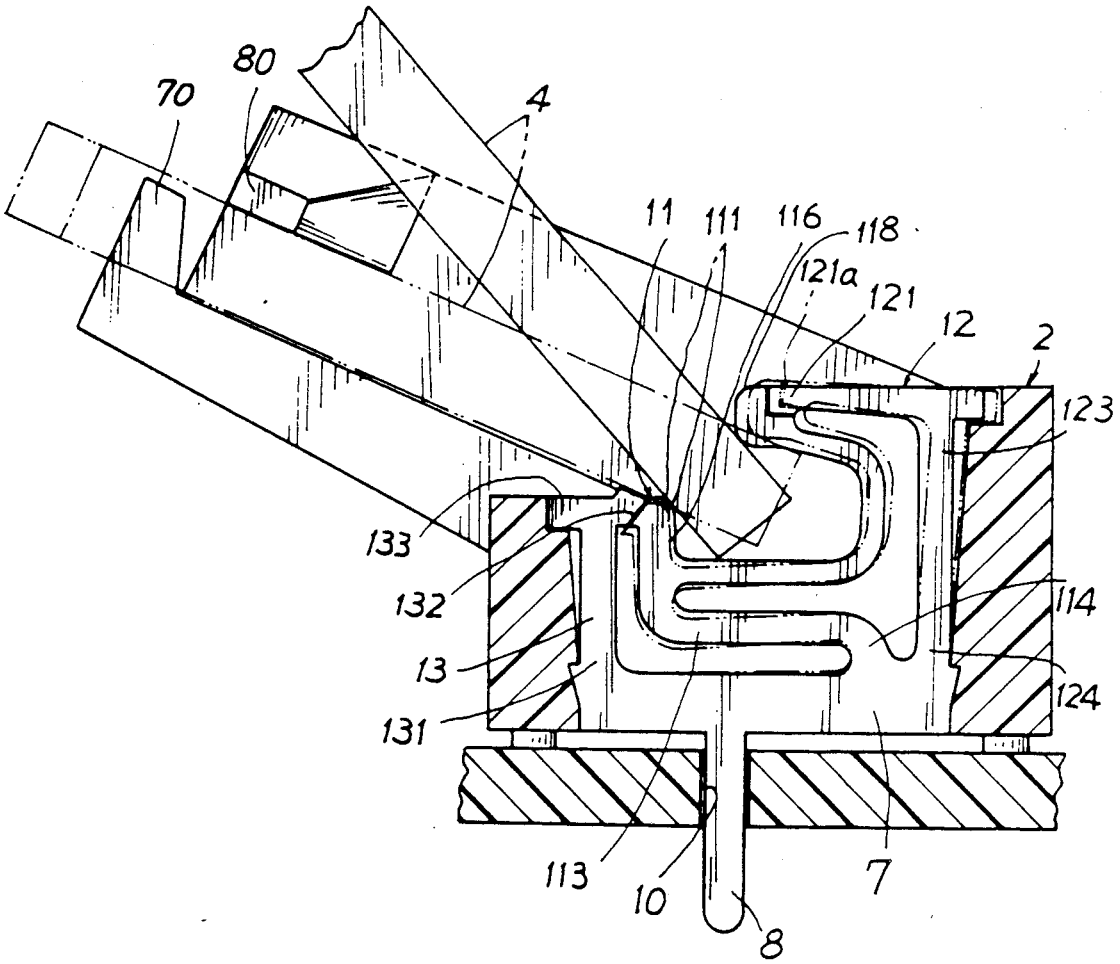
FIG. 5 shows still another preferred embodiment of the present invention.

As shown in FIG. 5, the first inner clamping arm member 116 includes a first contact point 111 contacting a left side of the board 4 and a second contact point 118 contacting a right side of board 4, and the outer supporting arm member 113 is formed as a curved structure and resiliently integrally secured to the base portion 7. An embedding arm member 13 is resiliently integrally secured to a left end of the base portion 7 having a pad portion 132 normally backing the first contact point 111 of the first contact portion 11 and operatively sliding or moving from the contact point 111 and having a shoulder extension 133 retained in the slot 5 in base 2. An upper extension portion of the pad 132 is provided to limit an insertion angle of the inserted daughter board. The second contact portion 12 includes an upper contact end portion 121 contacting the second contact point 118 and a second outer supporting member 123 connecting the contact end portion 121 and the base portion 7. A boundary line 121a is formed between end portion 121 and second contact point 118. The daughter board 4 may be inclinedly insert into the socket 3 as clamped by the two contact points 111, 118 and further fixed by the latch 70 and protrusion 80.

The present invention is superior to the conventional electrical connector with the following advantages:

1. Two spring contact portions 11, 12 are provided for resiliently clamping the inserted daughter board, thereby enforcing the clamping force more homogeneously or balanceably for an easier and lighter insertion of the board 4 in the connector for a sound electrical connection.
2. Plural boundary separating lines 6a, 6b, 6c are formed by cutting the relevant portions of the contact element 6 for adjusting, releasing or dampening any internal stress caused during an electrical connection.
3. The two contact portions 11, 12 may mutually compensate the stress existing in the connector system since either first contact portion 11 or second contact portion 12 is respectively inherently formed with spring force; and with separable sliding engagements of two cooperating parts at the boundary lines 6a, 6b, 6c so that an efficient connection of daughter board with the mother board, with lower insertion force but minimum stress influence will be achieved.
4. Whenever a regional fatigue failure of spring force exerting at one part of the contact element, the other portion of the contact element may compensate such a fatigue failure for ensuring a stable connection of the connector.

I claim:

1. A contact element of an electrical connector including a connector base having an elongate socket longitudinally formed in the connector base, a plurality of slots transversely formed in said elongate socket for receiving a plurality of contact elements therein, a daughter printed circuit board inserted through the socket to be clamped by the plurality of contact elements for connecting the daughter board to a mother board secured to the connector base, each contact element having a leg portion protruding downwardly to be connected with the mother board, the improvement which comprises:

said contact element including:

a first spring contact portion having a first inner clamping arm member arcuately extended and a first outer supporting arm member connected with the first inner clamping arm member resiliently integrally secured to a base portion embedded in a bottom portion in the connector base;

a second spring contact portion oppositely spaced apart from said first spring contact portion for clamping the daughter board in commensuration with said first spring contact portion having a second outer supporting arm member resiliently integrally secured to the other portion of said base portion opposite to said first outer supporting arm member; and at least a stress-adjusting means formed in said contact element for adjustably releasing or counterbalancing any internal stress caused when inserting the daughter board in the socket of connector base to be resiliently clamped by said first and second spring contact portion.

2. A contact element according to claim 1, wherein said stress-adjusting means is a boundary separating line formed in said contact element by directly cutting any said contact portion to form two cooperating parts normally engageable with each other and operatively sliding or moving to be slightly separated with each other for releasing any internal stress caused in the contact element.

3. A contact element according to claim 1, wherein said second spring contact portion includes a second inner clamping arm member clamping said daughter board in cooperation with said first spring contact portion, and a second outer supporting arm member integrally secured to said second inner clamping arm member.

4. A contact element according to claim 1, wherein said first spring contact portion includes said first inner clamping arm member for contacting a left side of said daughter board extending arcuately rightwardly towards said second spring contact portion having a central portion of said inner clamping arm member secured to said base portion and having a free end portion of said inner clamping arm member protruding upwardly to form a stress-adjusting means with said second spring contact portion; and wherein said second spring contact portion includes an upper contact projection for contacting a right side of said daughter board having said second outer supporting arm member integrally connected with said upper contact projection of said second spring contact portion.

5. A contact element according to claim 4, wherein said first inner clamping arm member includes a central portion connected with said base portion and a stress-adjusting means is formed between said central portion of the first inner clamping arm member and said base portion.

6. A contact element according to claim 4, wherein said first spring contact portion is formed with a stress-adjusting means between said first inner clamping arm member and said first outer supporting arm member.

7. A contact element according to claim 1, wherein said first spring contact portion includes a first inner clamping arm member arcuately extending towards said second spring contact portion having a first contact point contacting a left side of said daughter board and a second contact point formed on a free end portion of said first inner clamping arm member for contacting a right side of said daughter board opposite to said first contact point, and a first outer supporting arm member having an upper portion connected with said first inner clamping arm member and having a lower portion of said first outer supporting arm member secured to said base portion; and wherein said second spring contact portion includes an upper contact end portion contacted with said second contact point of said first inner clamping arm member and a second outer supporting arm member integrally secured with said upper contact end portion of said second spring contact portion and said base portion.

8. A contact element according to claim 7, wherein said first spring contact portion includes an embedding arm member having its lower portion integrally secured with said base portion, and having an upper portion of said embedding arm member backing said first contact point of said first spring contact portion.

9. A contact element according to claim 8, wherein said upper portion of said embedding arm member is formed with a pad backing said first contact point of said first spring contact portion, having an upper extension portion of the pad for limiting an insertion angle of an inserted daughter board.

* * * * *